United States Patent [19]

Strempel

[11] 4,027,719

[45] June 7, 1977

[54] ARGON BATH INDUCTION CASTING SYSTEM

[75] Inventor: Willy Strempel, Hamburg, Germany

[73] Assignee: Ultratek International, Inc., Concord, Calif.

[22] Filed: Mar. 24, 1976

[21] Appl. No.: 670,094

[52] U.S. Cl. ..... 164/51; 164/61; 164/62; 164/63; 164/65; 164/68; 164/114; 164/255; 164/258; 164/259; 164/289

[51] Int. Cl.² ..... B22D 13/00

[58] Field of Search ..... 164/51, 62, 63, 65, 164/68, 114, 251, 255, 258, 259, 286, 287, 289

[56] References Cited

UNITED STATES PATENTS

| | | | |
|---|---|---|---|
| 2,637,079 | 5/1953 | Kemppe | 164/287 X |
| 2,778,075 | 1/1957 | Huppert | 164/287 X |
| 3,052,001 | 9/1962 | Brennan | 164/251 |
| 3,234,604 | 2/1966 | Anderson | 164/255 |
| 3,818,974 | 6/1974 | Eberle | 164/255 |
| 3,845,807 | 11/1974 | Koon | 164/255 |
| 3,955,612 | 5/1976 | Schultheiss | 164/255 X |

FOREIGN PATENTS OR APPLICATIONS

| | | | |
|---|---|---|---|
| 46-759 | 9/1971 | Japan | 164/255 |
| 358,363 | 10/1931 | United Kingdom | 164/287 |

*Primary Examiner*—Ronald J. Shore
*Attorney, Agent, or Firm*—Harris Zimmerman

[57] ABSTRACT

A system for centrifugal casting of induction melted metal includes a crucible and a porous mold secured to a casting arm. The casting arm is secured to a hollow rotatable shaft which includes two separate fluid channels extending axially therethrough. The shaft is supported on a rotary valve which provides separate flow communication with each flow channel. One flow channel provides pressurized argon to the crucible to prevent oxide formation during casting. The other channel provides a vacuum to the exterior of the mold to draw gasses out of the metal, aid in the argon flow into the mold, and to augment the centrifugal flow of the molten metal into the mold.

9 Claims, 3 Drawing Figures

ARGON BATH INDUCTION CASTING SYSTEM

BACKGROUND OF THE INVENTION

The process of centrifugal casting of induction heated molten materials is well known in the prior art. The process is often used in the casing of precious or semi-precious metals into dental fixtures and the like, although it is certainly not limited to such use.

Generally, a centrifuge arm is provided which supports a crucible spaced radially inwardly from a mold secured to the arm. The casting metal is heated to a molten state in the crucible by high energy radio frequency radiation proivded by an induction coil. The centrifuge arm is then rotated at high speed, the centrifugal force urging the molten metal into the mold under high pressure to fill all of the extremities of the mold. The metal cools quickly in the mold to form the desired casting.

One drawback commonly found in this process is that it takes place in ambient air, and is subject to contamination from the air. Most significant is the contamination due to oxygen in the air, which reacts with the metal at the high temperatures found in the crucible, to form metal oxides. These oxides may degrade the structural strength of the casting, and may ruin the cosmetic appearance of the finished product.

SUMMARY OF THE INVENTION

The present invention generally includes a centrifugal casting method and apparatus which overcomes the metal oxide contamination problem known in the prior art. The apparatus includes a centrifuge arm having a porous mold support at the distal end thereof, and a crucible spaced radially inwardly therefrom. The centrifuge arm is secure to a tubular shaft which is provided with two fluid flow channels extending therethrough. One of the flow channels is connected to the crucible, and is provided with an inert gas under pressure. This gas, such as argon, is supplied to the curcible prior to the melting of the metal, so that all oxygen is washed away and cannot contaminate the melt.

The other flow channel is connected to a vacuum pumping system at one end, and to the porous mold support at its distal end. The vacuum serves to draw the inert gas through the mold to remove contaminating gasses therefrom, and to promote the flow to the metal into the mold cavity. Thus the metal is bathed in inert gas from the time it becomes molten until it cools to a solid phase in the mold.

The tubular shaft is supported by a rotary valve which provides separate flow communication with each flow channel in the shaft as the shaft turns. The rotary valve includes an arbor having concentric flow passages extending along the axis of the arbor. The arbor is supported in a housing by three sealed ball bearings, the housing being provided with axially spaced tapered threaded holes disposed between the bearings. The arbor is provided with a port extending radially therein for each flow passage, each port being spaced in correspondence with one of the threaded holes in the housing. Thus the arbor may rotate freely while the fluid flow through the separate passages continues uninterrupted.

THE DRAWING

DESCRIPTION OF THE PREFERRED EMBODIMENT

Figure 1:
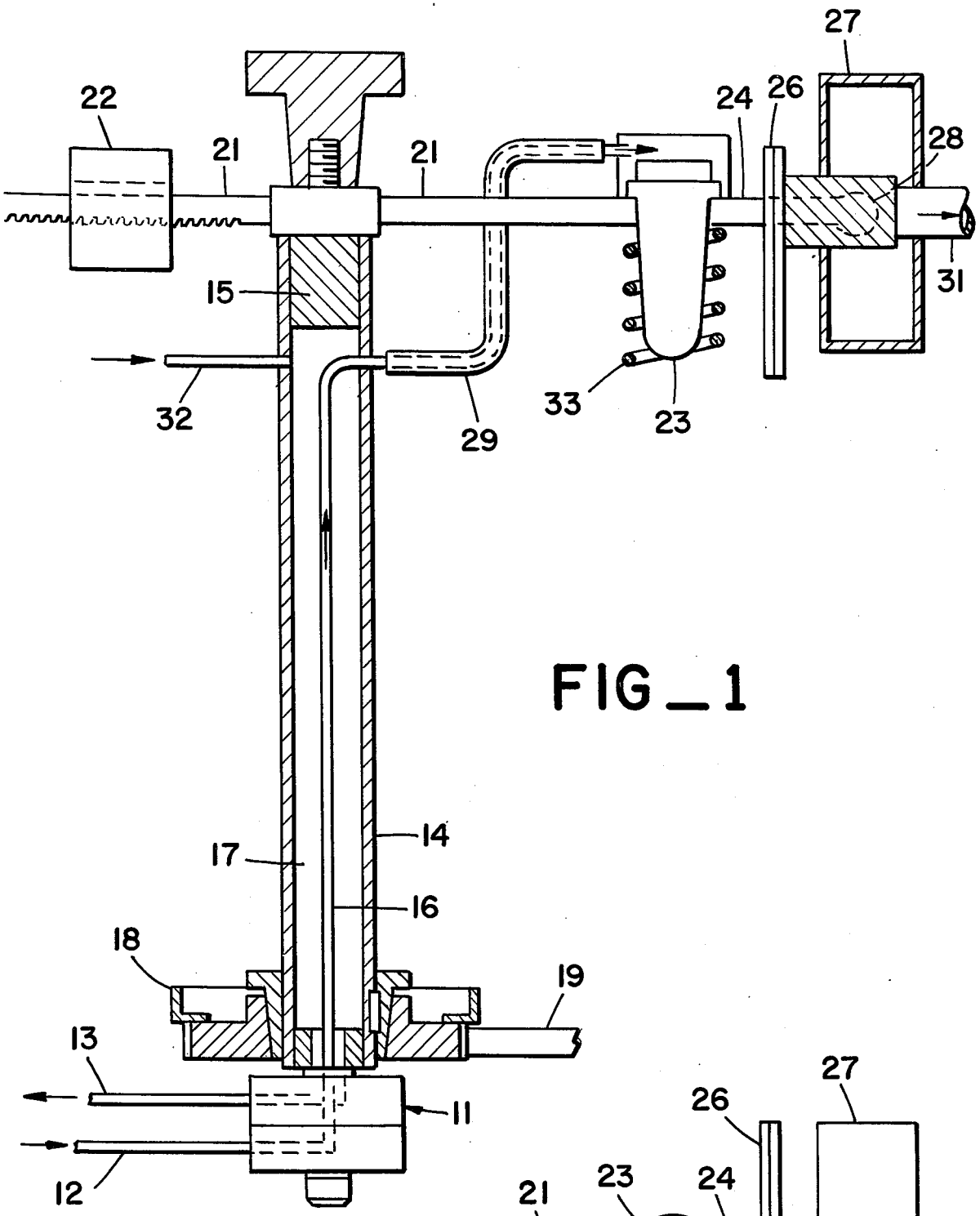
FIG. 1 is a cross-sectional elevation of the present invention.

With reference to FIG. 1, the present invention generally includes a rotary valve 11 having two flow channels 12 and 13 extending therethrough, and a tubular shaft 14 secured coaxially with the rotating arbor of the valve. The shaft 14 includes a tubular passage 17 therein which is connected with the flow channel 13 of the valve. The upper end of the passage 17 is sealed with a plug 15. A gas delivery tube 16 extends along the axis of the shaft, and is connected to the flow channel 12 of the rotary valve. A sprocket wheel 18 is secured in fixed relationship to the lower end of the shaft 14, and a timing belt 19 engages the sprocket wheel to drive the shaft in rotational motion.

Figure 2:
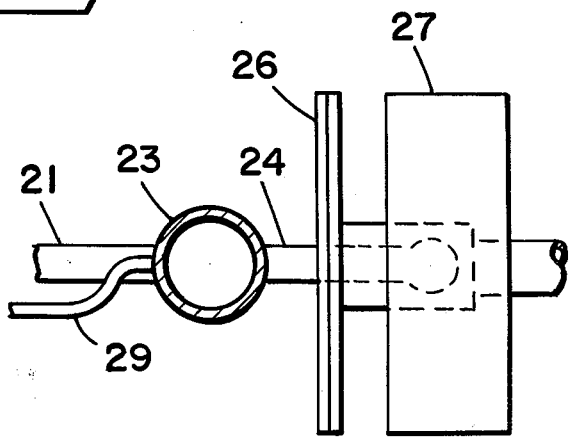
FIG. 2 is a detailed top view of a portion of the present invention.

The upper end of the shaft 14 is joined to a centrifuge arm 21, which is provided with an adjustable counterweight 22 at one end thereof. Secured to the other end of the centrifuge arm is a sealed crucible 23 as shown also in FIG. 2, which is adapted to retain a charge of metal which is heated therein to a molten state. Joined to the crucible and in flow communication therewith is a delivery tube 24. A porous mold 28 is joined to the delivery tube 24 by means of a removable asbestos seal 26 having a channel therethrough. The mold is disposed within a closed mold support 27. Extending from the distal end of the mold and through the mold support is a vacuum tube 31.

The passage 17 of the shaft 14 is provided with a connector 32, and a tube or pipe (not shown) joins the connector 32 and the vacuum tube 31. The gas delivery tube 16 exits from an upper portion of the shaft, and a tube 29 connects the tube 16 to the sealed crucible 23. Thus a sealed flow communication extends from the channel 13 through the passage 17 and the connector 32 to the mold 28. The channel 13 is connected to a vacuum pump. The gas delivery tube 16, the flow channel 16, and the tube 29 comprise a sealed flow passage to the crucible. The flow channel 12 is connected to a source of pressurized inert gas, such as argon.

The invention also includes an induction heating coil 33 which is adapted to be positioned about the crucible 23 by a mechanism known in the prior art. The coil 33 is connected to a source of high power radio frequency energy which heats a charge of metal in the crucible to a molten state. The melting process takes place while argon is flowing through the crucible and the vacuum applied to vacuum tube 31 is drawing gases through the porous mold. The melt thus takes place in a completely inert atmosphere, so that there can be no oxide formation. The inert atmosphere also fills the mold cavity, the argon being drawn through the porous mold by the vacuum applied thereto.

The induction coil is then lowered, and the centrifuge arm is rotated at high speed by the timing belt 19, while the vacuum and argon flow continue. The molten metal is driven by the centrifugal force through the tube 24 and the seal 26 and into the mold 28. The vacuum applied to the mold aids in drawing the metal into every extremity of the mold cavity. The vacuum also eliminates any porosity in the casting by drawing out any gas bubbles in the molten metal. After sufficient time the centrifuge arm is stopped, and the seal 26 is separated to remove the mold and mold support.

Figure 3:
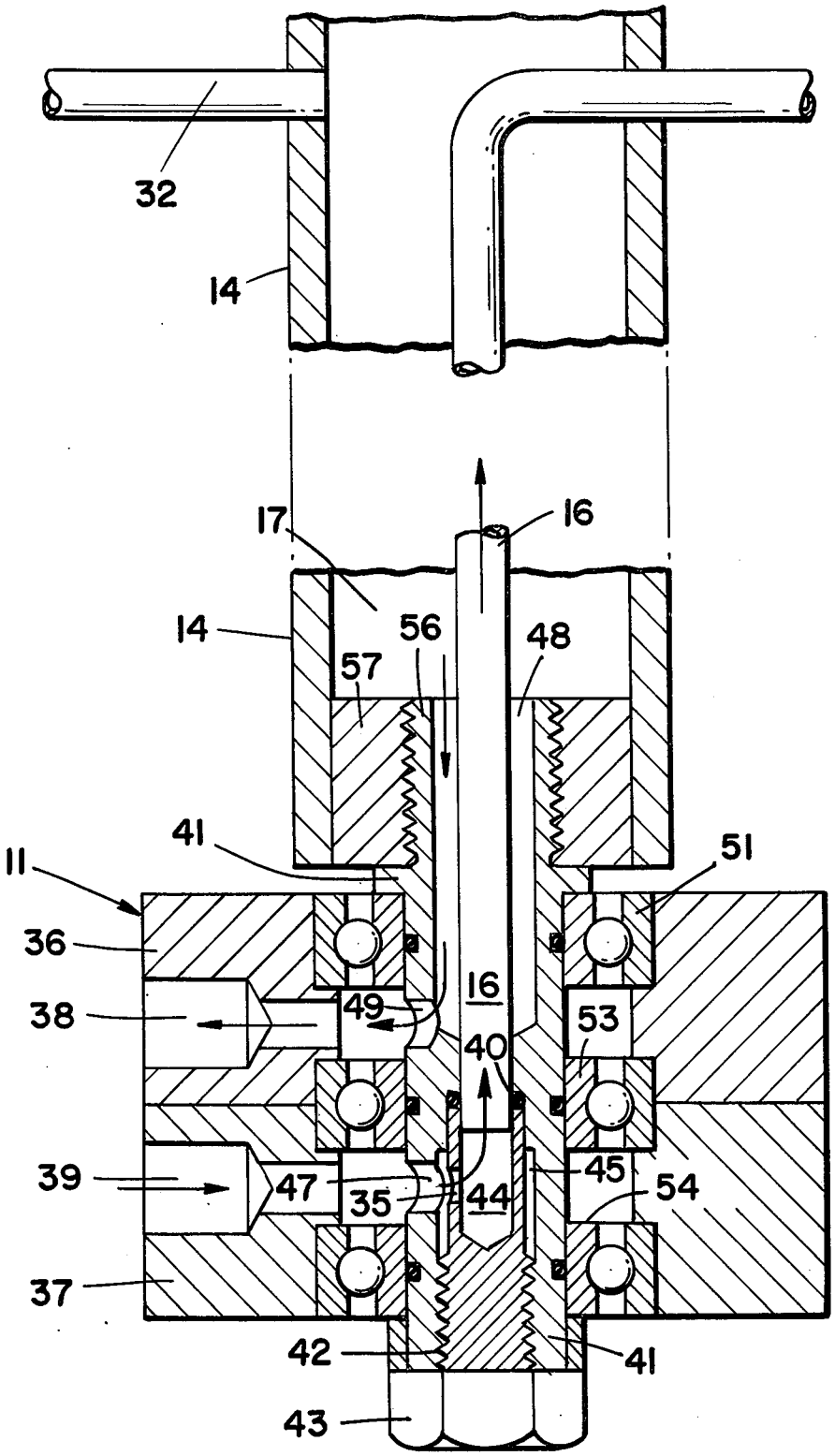
FIG. 3 is a cross-sectional elevation of the rotary valve of the present invention.

A most salient feature of the present invention is the rotary valve which facilitates the simultaneous delivery of a vacuum line and a pressurized gas line to a rotating arm. As shown in FIG. 3, the valve 11 includes a pair of annular housing members 36 and 37 disposed in adjoining axial relationship. The housing members are provided with ports 38 and 39, respectively, each port including a tapered threaded portion for securing a threaded pipe or tube. The housing members are joined together by screws or bolts (not shown) extending parallel to the axis of the members.

Disposed within the axial cavity of the housing members is a rotating arbor 41. One end of the arbor is provided with a partially threaded hole 42 in which a cap screw 43 is secured. The hole 42 extends through the arbor to a bore 48 extending axially from the other end of the arbor. The interior end of the screw 43 and the hole 42 defined an annular cavity 45, which is connected in open flow communication with the port 39 by means of a hole 47 extending radially in the arbor. The interior end of the screw is also provided with an axially extending hole 44 which receives the end of the gas delivery tube 16. An O-ring seal 40 seals the tube 16 in the hole 42 of the arbor. The screw 42 is also provided with a pair of diametrically extending holes 35 which connect the hole 44 with the annular cavity 45. Thus the flow channel consists of the port 39, the hole 47, the cavity 45, the hole 35, the hole 44 in the screw, and the gas delivery tube 16.

The outer end of the bore 48 is in open communication with the tubular passage of the shaft 14. The inner end of the bore is provided with a radially extending hole 49 which provides flow communication between the bore 48 and the port 38. The upper end of the arbor, as seen in FIG. 3, is provided with an externally threaded portion 56, and a cylindrical plug 57 is secured thereto. The plug 57 is press fit into the shaft 14, thus joining the shaft to the arbor of the valve.

Secured within the axial cavity of the housing members is a trio of axially spaced sealed ball bearings 51, 53, and 54. The arbor is press fit into the inner races of the bearings with O-ring seals to effect of leakproof seal between the flow channels and the ambient air. Thus the arbor freely rotates on the bearings while there is provided continuous flow communication in the gas delivery channel 39–16 and in the vacuum channel 38–17.

I claim:

1. A method of metal casting, comprising the steps of providing a crucible secured to a centrifuge arm, and a metal flow channel extending therefrom to a porous mold spaced radially outwardly therefrom, supplying an inert gas to said crucible, applying a continuous vacuum to the exterior distal portions of said porous mold to draw said inert gas through said channel and said mold, heating a metal charge to a molten state in the inert gas bath in said crucible, and rotating said centrifuge arm to drive said metal into said mold, said vacuum removing any gas from the molten metal.

2. The method of claim 1, wherein said step of heating said metal charge includes disposing an induction coil about said crucible and applying radio frequency energy to said coil.

3. An apparatus for metal casting, comprising a centrifuge arm, a crucible secured to said arm, a porous mold secured to said arm and spaced radially outwardly from said crucible, a closed metal flow channel extending between said crucible and said mold, rotating means for rotating said centrifuge arm at high speed, gas delivery means for supplying an inert pressurized gas to said crucible, said metal flow channel, and said mold, and vacuum means for continuously applying a vacuum to the exterior distal portions of said mold.

4. The apparatus of claim 3, wherein said rotating means includes a shaft secured to said centrifuge arm.

5. The apparatus of claim 4, wherein said gas delivery means and said vacuum means includes separate, sealed fluid channels extending through said shaft to said crucible and said mold, respectively.

6. The apparatus of claim 5, further including a rotary valve supporting said shaft, said valve including means for providing separate flow communication to said fluid channels.

7. An apparatus for metal casting, comprising a centrifuge arm, a crucible secured to said arm, a porous mold secured to said arm and spaced radially outwardly from said crucible, a closed metal flow channel extending between said crucible and said mold, rotating means for rotating said centrifuge arm at high speed, gas delivery means for supplying an inert pressurized gas to said crucible, said metal flow channel, and said mold, and vacuum means for continuously applying a vacuum to the exterior distal portions of said mold, said rotating means including a rotary valve for supplying said gas delivery means and said vacuum means, and said rotary valve including a arbor having a pair of concentric flow passages extending axially therein.

8. The apparatus of claim 7, further including a housing disposed about said arbor, said housing including a pair of ports, each port communicating with one of said flow passages.

9. The apparatus of claim 8, wherein said arbor extends through a hole in said housing, and further including a plurality of bearings disposed between said housing and said arbor.

* * * * *